US008144107B2

(12) United States Patent
Toffoli et al.

(10) Patent No.: US 8,144,107 B2
(45) Date of Patent: Mar. 27, 2012

(54) METHOD AND/OR APPARATUS TO IMPROVE THE VISUAL PERCEPTION OF AN IMAGE DISPLAYED ON A SCREEN

(75) Inventors: Domenico Toffoli, Prata di Pordenone (IT); Mario Raffin, Pordenone (IT)

(73) Assignee: SIM2 Multimedia SpA, Pordenone (IT)

( * ) Notice: Subject to any disclaimer, the term of this patent is extended or adjusted under 35 U.S.C. 154(b) by 775 days.

(21) Appl. No.: 11/795,706

(22) PCT Filed: Feb. 3, 2006

(86) PCT No.: PCT/IB2006/000201
§ 371 (c)(1),
(2), (4) Date: Apr. 11, 2008

(87) PCT Pub. No.: WO2006/092679
PCT Pub. Date: Sep. 8, 2006

(65) Prior Publication Data

US 2008/0191996 A1 Aug. 14, 2008

(30) Foreign Application Priority Data

Feb. 16, 2005 (IT) ..... TO2005A0090

(51) Int. Cl.
*G09G 3/36* (2006.01)

(52) U.S. Cl. ..... 345/102; 345/87; 345/212

(58) Field of Classification Search ..... 345/84, 345/87, 89, 102, 211–214
See application file for complete search history.

(56) References Cited

U.S. PATENT DOCUMENTS

| | | | | |
|---|---|---|---|---|
| 6,795,053 | B1 * | 9/2004 | Funamoto et al. | 345/102 |
| 7,265,743 | B2 * | 9/2007 | Funamoto et al. | 345/102 |
| 7,414,608 | B2 * | 8/2008 | Funamoto et al. | 345/102 |
| 7,595,784 | B2 * | 9/2009 | Yamamoto et al. | 345/102 |
| 2004/0201561 | A1 * | 10/2004 | Funamoto et al. | 345/89 |
| 2004/0201562 | A1 * | 10/2004 | Funamoto et al. | 345/89 |
| 2006/0146005 | A1 * | 7/2006 | Baba et al. | 345/102 |
| 2007/0182700 | A1 * | 8/2007 | Baba et al. | 345/102 |

FOREIGN PATENT DOCUMENTS

| | | | |
|---|---|---|---|
| EP | 1 111 578 | | 6/2001 |
| JP | 2001134226 | A | 5/2001 |
| JP | 2002357810 | A | 12/2002 |
| JP | 2003036063 | A | 2/2003 |
| JP | 2003257694 | A | 9/2003 |
| JP | 2004004606 | A | 1/2004 |
| WO | WO 2004/049292 | | 6/2004 |

OTHER PUBLICATIONS

Written Opinion of the International Searching Authority, PCT/IB2006/000201, dated Sep. 8, 2006.

* cited by examiner

*Primary Examiner* — Amare Mengistu
*Assistant Examiner* — Dmitriy Bolotin
(74) *Attorney, Agent, or Firm* — Buchanan Nipper

(57) ABSTRACT

The invention relates to a method and/or apparatus to improve the visual perception of an image displayed on a liquid crystal (LCD) panel, said method comprising steps for generating an adjusting signal ($P_{E,i}$+1) of a rear-lighting lamp of said panel depending on an target power value ($P_T$) and for generating a control signal ($C_{E,i}$+1) of the image contrast depending on said adjusting signal ($P_{E,i}$+1) of the rear-lighting lamp so as to increase/decrease the contrast of the displayed image when said adjusting signal ($P_{E,i}$+1) of the rear-lighting lamp decreases/increases.

10 Claims, 4 Drawing Sheets

METHOD AND/OR APPARATUS TO IMPROVE THE VISUAL PERCEPTION OF AN IMAGE DISPLAYED ON A SCREEN

The present invention relates to a method and/or apparatus for improving the visual perception of images displayed on a screen, in particular on a liquid crystal screen (LCD, Liquid Crystal Display).

In particular, the present invention relates to a method and/or apparatus adapted to improve the visual perception of dark images, i.e. low-brightness images, displayed on an LCD screen.

As known, LCD screens are illuminated by using a rear-lighting lamp, which is a source of white light.

When displaying images on an LCD screen, a portion of the light produced by the rear-lighting lamp goes through the LCD screen also through pixels which should be off. This phenomenon, called "light leakage", has the consequence of reducing the screen contrast ratio, i.e. the ratio between bright and dark tones of an image displayed on the screen.

According to the state of the art, methods and/or apparatus are known which allow to improve the perception of images displayed on a screen.

For instance, the PCT International Patent Application No. WO 2004/049293 describes a method to improve the perception of images displayed on a screen by measuring the value of a number of parameters, among which the brightness of a frame and that of the single pixels composing it. In relation with the values of the measured parameters, an adjusting circuit generates a global brightness control signal and a local brightness control signal. The global adjustment is carried out by means of an optical diaphragm.

For instance, the U.S. patent application Ser. No. 2001/0033260 describes a liquid crystal display (LCD) device comprising a liquid crystal panel, a rear-lighting lamp for illuminating the liquid crystal panel, a section for detecting the luminance characteristics of a frame, and a section for controlling the rear-lighting lamp in order to adjust the light produced by the rear-lighting lamp in accordance with the luminance characteristics of the frame.

However, these methods do not take into account the evolution of the scenic contents of the images to be displayed, in that they are based on the analysis of a single image frame and provide for the image adjustment according to it.

Thus, when sudden changes in the scenic contents occur, e.g. during a scene change from a sunny landscape to a poorly lit indoor environment or a night scene, the methods according to the known art do not take into account the marked sensitivity of the human eye to such sudden variations.

The object of the present invention, therefore, is to provide a method and/or apparatus to improve the visual perception of the images displayed on a screen, said method and/or apparatus being effective and operating according to the scenic contents of such images. This and other objects of the invention are achieved by the method as claimed in the annexed claims.

According to a first aspect of the present invention, a method and/or an apparatus is proposed which exploits the rear-lighting lamp power adjustment and the contrast adjustment in order to obtain higher contrast ratios whenever it is not necessary to use the maximum available lamp power.

The method and/or apparatus according to the invention therefore operates in the darkest scenes, i.e. when the image histogram is unbalanced toward the lowest luminance levels. In such a case, in fact, it is possible to reduce the power of the rear-lighting lamp power, thereby lowering the level of black, and then to recover the intermediate luminance levels by acting on the signal, in particular by increasing the contrast.

Since the method and/or apparatus operates in dark scenes, the levels of white which might be saturated as a consequence of the contrast increase will not produce relevant counterfeits, and the images will be advantageously perceived by the observer as more contrasted.

The method and/or apparatus according to the invention provides a gradual variation of the brightness of the image perceived by the observer, so that such brightness variation will not be perceived by the observer as a disturbing flickering.

Moreover, the method and/or apparatus according to the invention takes into consideration the brightness variations occurring during the scene changes of the images, e.g. when there is a transition from a sunny landscape to a poorly lit indoor environment or a night scene.

According to a further aspect of the invention, the following will describe a liquid crystal panel implementing the method according to the present invention and a liquid crystal screen to which said panel is fastened.

The above objects will become apparent from the detailed description of the method and/or apparatus according to the invention, with particular reference to the annexed figures, wherein.

Figure 1:
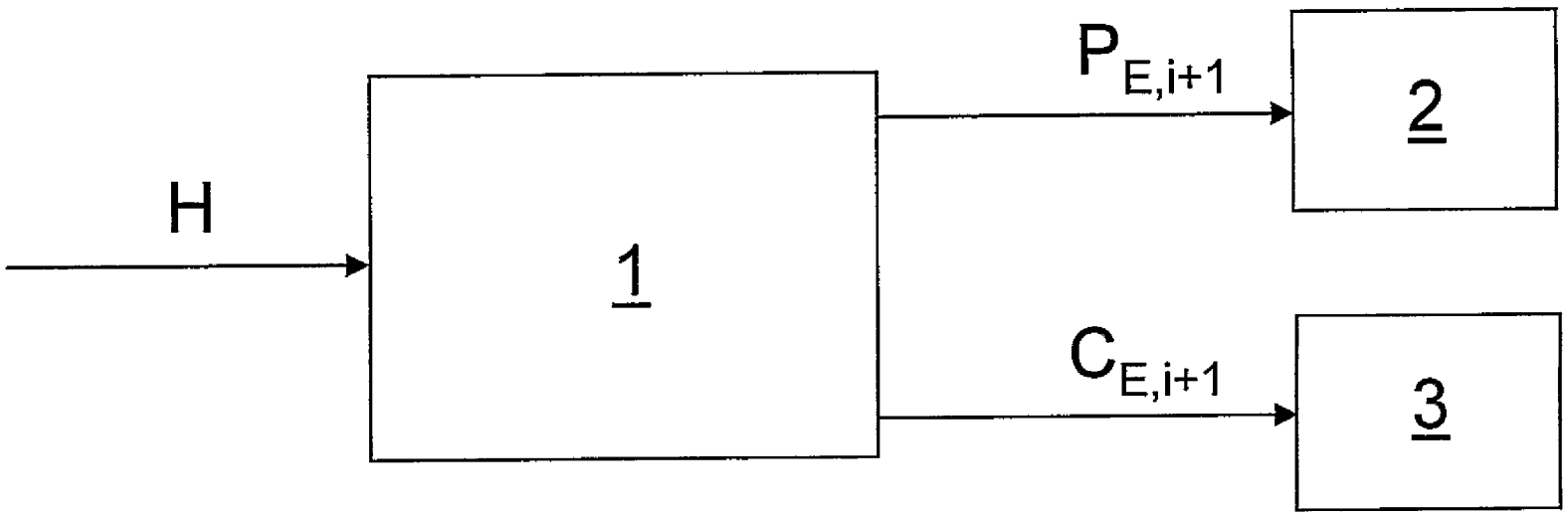
FIG. 1 shows a basic diagram of the architecture implementing the method and/or apparatus according to the invention.

FIG. 1 illustrates a basic diagram of the architecture implementing the method and/or apparatus according to the invention, wherein an image frame H is received by an analysis and adjusting block 1, which analyses a plurality of image frames H and outputs a signal $P_{E,i+1}$ adapted to adjust the power of the rear-lighting lamp of a liquid crystal (LCD) panel, not shown, and a signal $C_{E,i+1}$ adapted to adjust the contrast of the image displayed on a screen, also not shown, to which said panel is fastened.

The signals $P_{E,i+1}$ and $C_{E,i+1}$ are sent to a power adjusting circuit 2 of a rear-lighting lamp and to an image contrast control circuit 3, respectively.

Figure 2:
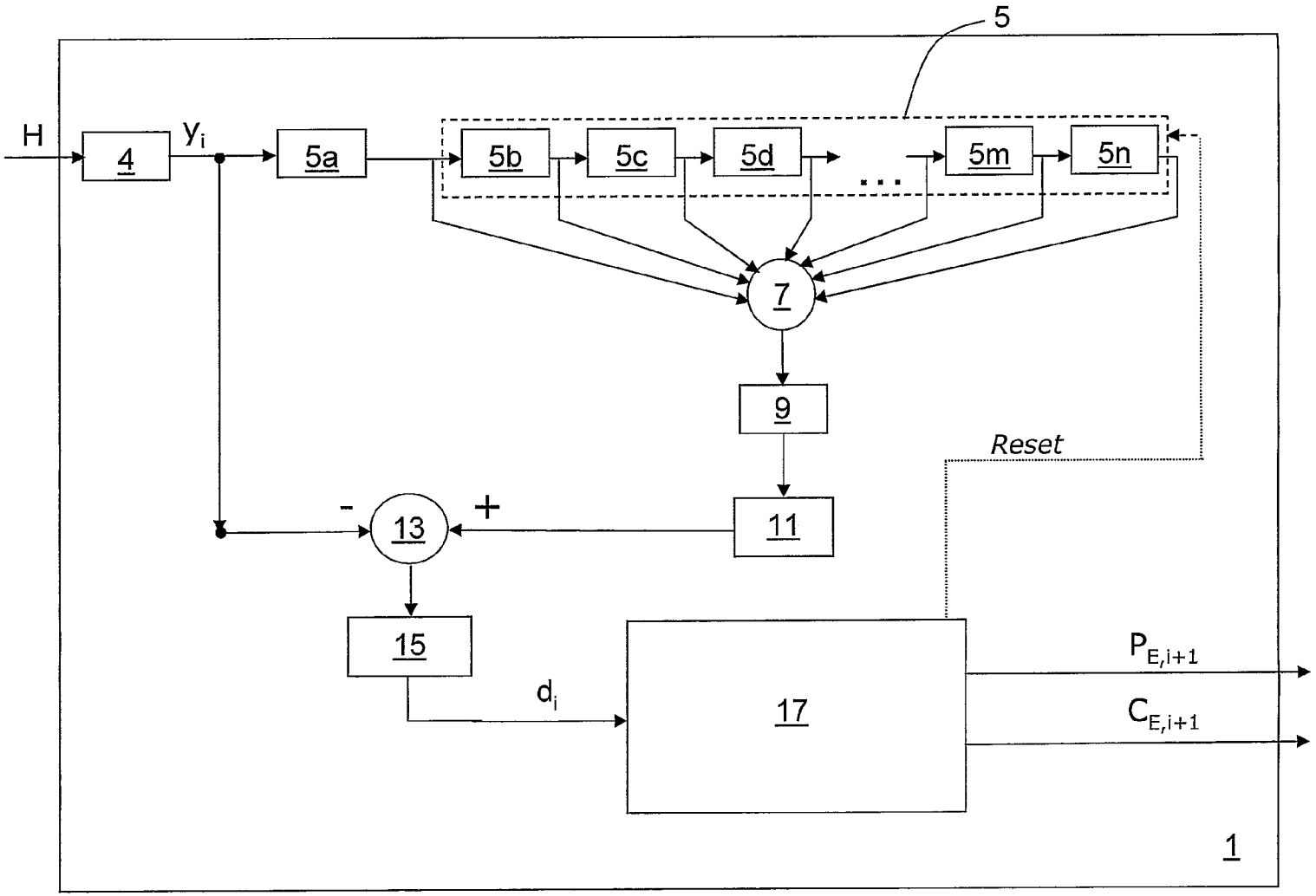
FIG. 2 shows a block diagram of an analysis and adjusting block used by the method and/or apparatus according to the invention.

FIG. 2 illustrates in detail the analysis and adjusting block 1, which comprises: a block 4 which calculates the spatially averaged luminance of a frame H; a sliding register 5 made up of $2^N$ cells 5*a* . . . 5*n*, preferably of 8 bits, wherein N is an integer; a module for calculating the absolute value of the difference between the mean luminance of the current frame $y_i$ and the average of the mean luminances of the previous frames, consisting of a first adder 7, a register 9, a divisor 11, a second adder 13 and a module 15 which calculates the absolute value; and, finally, a control block 17 operation of which will be detailed later.

The analysis and adjusting block 1 may be either implemented in a dedicated microprocessor or provided by advantageously programming a dedicated microprocessor of the LCD panel.

The value of the mean luminance $y_i$ of a frame H at the instant i is obtained from the values of the primary colours R,G,B as specified by the NTSC and PAL standards, which establish the reference chromaticity for the primary colours R,G,B and for white according to the following formula:

$$y_i=0.299\cdot R+0.587\cdot G+0.114\cdot B$$

In practice, the analysis and adjusting block 1 operates as follows.

At each frame H, the mean luminance $y_i$ of the frame H is first calculated in the block 4. The value $y_i$ is then entered in the sliding register 5.

The adder 7 calculates the sum $S_i$ of all the cells of the sliding register 5. This sum $S_i$ is stored in a register 9 and divided by $2^N$ by the divisor block 11 so as to output the value $S_i/2^N$. This value is subtracted from the value of the mean luminance of the current frame $y_i$ in the adder 13. In the block 15, the absolute value of the value at the output of the block 13 is calculated, so that the block 15 outputs the value $d_i=|(S_i/2^N-y_i)|$.

The value $d_i$ represents the distance between the mean luminance $y_i$ of the current frame and the average of the mean luminances of the previous frames. The value $d_i$ is therefore an indicator of the proximity between the luminance of the current frame i and that of the $2^N$ previous frames. In practice, the analysis and adjusting block 1 acts as a detector of the differential luminance between a frame and the previous ones.

The control block 17 can generate a command signal RESET which sets to $y_i$ all the cells 5*a* . . . 5*n* of the sliding register 5. The usefulness of this setting will become apparent from the following description.

Figure 3:
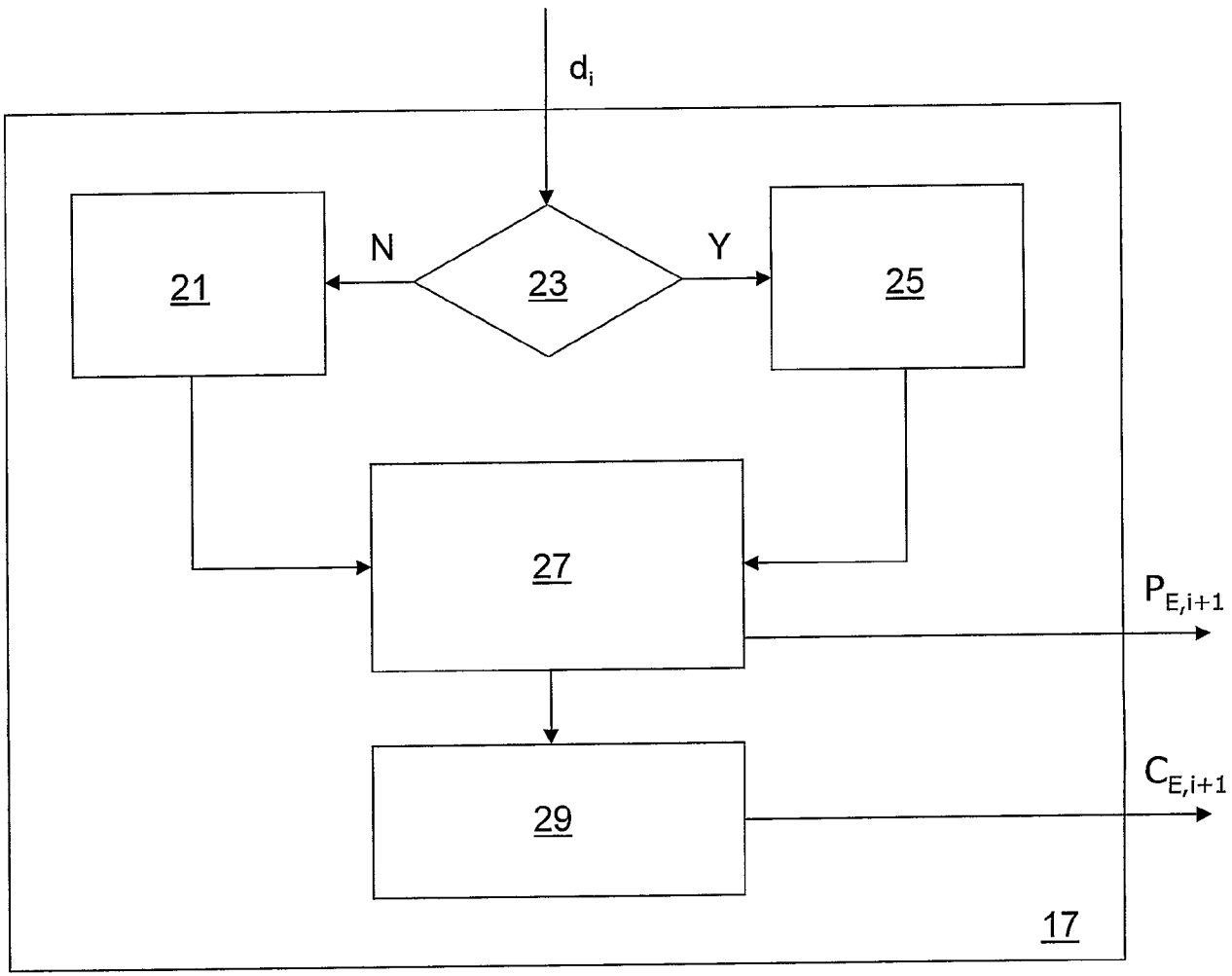
FIG. 3 is a block diagram which illustrates the detailed operation of a control block contained in the analysis and adjusting block of FIG. 2.
Figure 4:
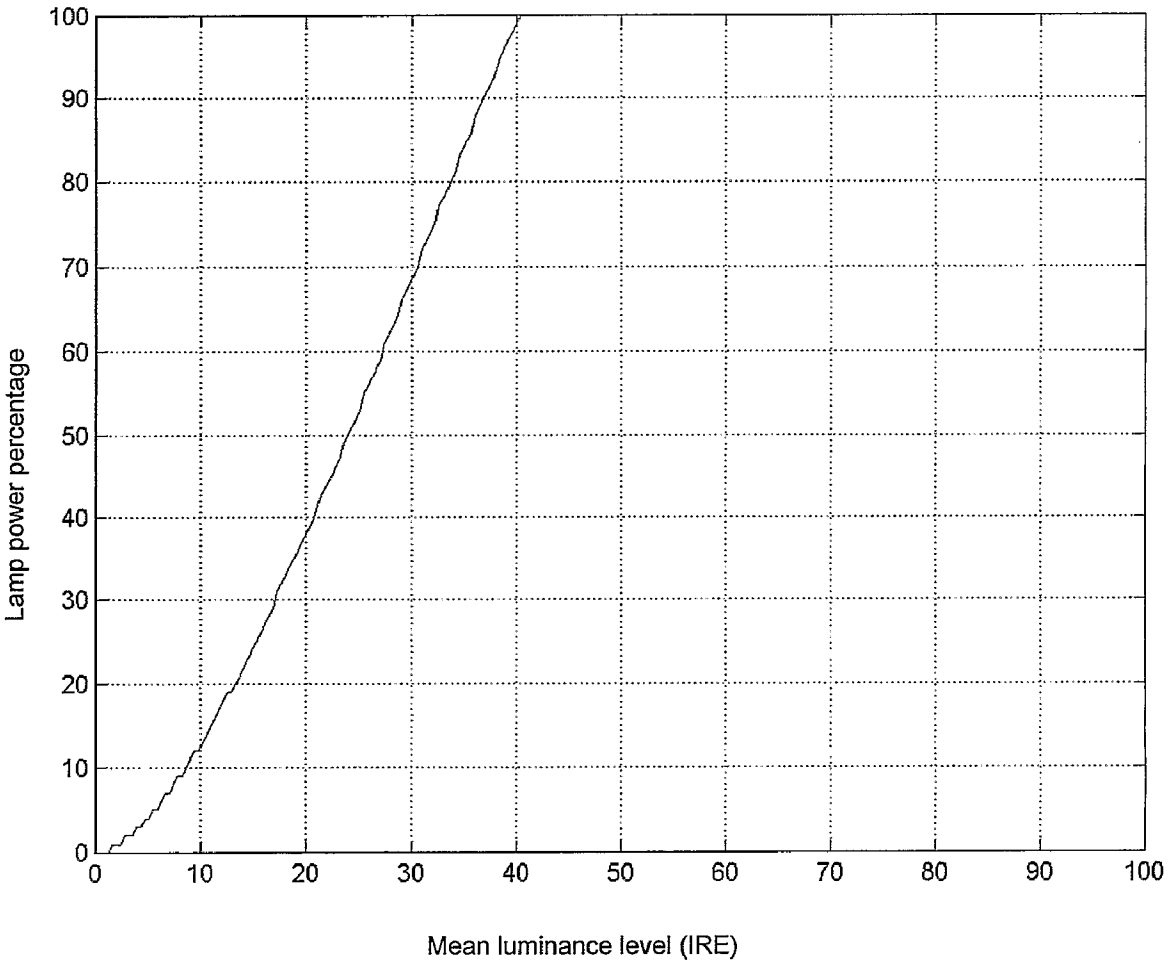
FIG. 4 shows a graph values of which are stored in a table used by the method and/or apparatus according to the invention.

FIGS. 3 and 4 respectively illustrate in detail a block diagram describing the operation of the control block 17 and a graph representing a function the values of which are used within the control block 17.

The control block 17 receives the signal $d_i$ from the output of the block 15 and outputs a power adjusting signal $P_{E,i+1}$ of a rear-lighting lamp and a contrast control signal $C_{E,i+1}$.

Within the control block 17, the "target" values for power $P_T$ of the lamp and contrast $C_T$ are established.

The "target" values for power of the lamp and contrast are defined according to a function determined empirically by analyzing a wide range of cinematographic scenes.

According to such analysis, every scene has been empirically classified as "bright" or "dark", and for each one of them the mean level of luminance has been detected.

It has been found that the level of discrimination between dark and bright scenes is located at rather low mean luminance levels of approximately 20 IRE (1 IRE=7.143 mV).

High levels of R,G,B are not typically detected below 10 IRE, so that it is possible to considerably reduce the lamp power, while increasing the image contrast proportionally, without generating heavy counterfeits due to saturation.

Above an average value of 40 IRE, finally, the scenes appear bright and there is no need to reduce the lamp power in order to increase depth in dark colours.

On the basis of these observations, a non-linear function $F_x$ has been defined, as shown in FIG. 4, which maps luminance levels, averaged over space and time, to light levels of the rear-lighting lamp.

The function $F_x$ is stored in a Look Up Table F[•].

Since in practice it would not make much sense to turn the lamp completely off (value 0 in FIG. 4), the values on the X axis of FIG. 4 are remapped linearly from the interval [0, 100] to a power value interval [$P_{min}$, $P_{max}$] through the following function:

$$P(P')=P_{min}+P'(P_{max}-P_{min})/100$$

wherein $P_{min}$ is a number greater than zero.

By convention it is defined $P_T\in[0, 100]$. Such values are established in such a way that the loss of contrast caused by the lamp power decrease is recovered through a contrast increase within the saturation limits.

For example, by halving the lamp power and doubling the contrast, a mean grey will always have the same brightness, but all greys above the mean grey will become saturated and will have the same brightness as the mean grey.

This adjustment does not cause counterfeits in the image, just because the lamp power reduction is applied in scenes wherein the histogram is concentrated in the low grey levels.

Back to the block diagram of FIG. 3, at the step 23 the value $d_i$, which represents the distance between the mean luminance of the current frame i and the average of the mean luminances of the previous frames, is compared with a predefined threshold value $t_L$.

If $d_i<t_L$, the procedure arrives at the step 25, wherein the value $y_i$ is entered into the sliding register 5 and the "target" power is calculated according to the formula $P_{T,i}=F[round(S_i/2_N)]$; otherwise, i.e. if $d_i>t_L$ the procedure arrives at the step 21, wherein the sliding register 5 is reset through the command signal RESET, all the cells 5*a* . . . 5*n* of the sliding register 5 are initialized to $y_i$, and the "target" power is calculated according to the formula $P_{T,i}=F[y_i]$.

The threshold value $t_L$ is therefore advantageous because it prevents from averaging in time frames having very different scenic contents, such as, for instance, a sunny landscape followed by a night scene. In this way, the method according to the invention takes into account the marked sensitivity of the human eye to sudden variations of the scenic contents of the image.

At the step 27, a control function recalled periodically every 200 ms sets the effective values of lamp power and contrast, designated $P_{E,i+1}$ ($P_{E,i+1}\in[0, 100]$) and $C_{E,i+1}$, respectively. The value $P_{E,i+1}$ is increased or decreased at each step depending on the "target" value $P_{T,i}$ as follows:

if $P_{E,i}<P_{T,i}\rightarrow P_{E,i+1}=P_{E,i+1}$
if $P_{E,i}=P_{T,i}\rightarrow P_{E,i+1}=P_{T,i}$
if $P_{E,i}>P_{T,i}\rightarrow P_{E,i+1}=P_{E,i+1}$ The value $P_{E,i+1}$ is used at the step 29 to calculate the updated contrast value $C_{E,i+1}$ to be provided to the contrast adjusting circuit according to the following formula:

$$C_{E,i+1}=C_{ut,i}+k_c[1-P_{T,i}/100]$$

wherein the constant $k_c$ is determined by setting so that the light emitted by the panel at a given level of grey (such that it is never brought to saturation by contrast variations) remains constant as the power of the rear-lighting lamp and the contrast change as described. Constant $k_c$ is dependent on the type of the panel and, once it has been established by the manufacturer once for all, it is a constant parameter. The contrast value $C_{E,i+1}$ is therefore made up of two addends: a first fixed addend $C_{ut}$ being adjustably determined by the user, and a variable addend having the purpose of recovering the brightness lost when reducing the power and therefore also the brightness of the rear-lighting lamp.

It is clear that the above description is provided by way of a non-limiting example, and that variations and changes are possible without departing from the scope of the invention.

The invention claimed is:

1. Method for improving the visual perception of an image displayed on a liquid crystal screen, said method comprising at least steps for:

generating an effective adjusting signal ($P_{E,i+1}$) of a rear-lighting lamp depending on the value of a target power value ($P_T$) of said rear-lighting lamp; and generating an effective image contrast control signal ($C_{E,i+1}$) depending on said effective adjusting signal of the rear-lighting lamp, so as to, increase, respectively decrease, the contrast of the image displayed on said screen as said effective adjusting signal ($P_{E,i+1}$) of the rear-lighting lamp decreases, respectively increases;

wherein said target power value ($P_T$) of said rear-lighting lamp is calculated as a function of the average of the mean luminances ($S_i/2^N$) of a predetermined plurality of previous image frames if the distance ($d_i$) between the mean luminance ($y_i$) of a current image frame (H) and the average of the mean luminances ($S_i/2^N$) of said predetermined plurality of previous image frames is less or equal to a threshold value ($t_L$), otherwise said target power value ($P_T$) of said rear-lighting lamp is calculated as a function of the mean luminance ($y_i$) of said current image frame (H) and the mean luminance of said predetermined plurality of previous image frames is initialized to the mean luminance ($y_i$) of the current image frame (H).

2. Method according to claim 1, wherein said target power value ($P_T$) is defined according to a table obtained empirically through observation of a plurality of scenes having different brightness.

3. Method according to claim 1, wherein said threshold value ($t_L$) allows to discriminate the scenic contents of a plurality of image frames (H).

4. Method according to claim 1, wherein said effective signals for adjusting the rear-lighting lamp ($P_{E,i+1}$) and for controlling the contrast ($C_{E,i+1}$) are generated at predetermined time intervals.

5. Method according to claim 4, wherein said time intervals are of 200 ms.

6. Method according to claim 1, wherein said effective contrast control signal ($C_{E,i+1}$) is made up of a first addend ($C_{ut,i}$), adjustably determined by an user, and a second variable addend depending on said effective power signal ($P_{E,i+1}$) for adjusting the rear-lighting lamp.

7. Method according to claim 6, wherein said second variable addend is given by the formula $$k_c \times [1 - P_{T,i}/100]$$

wherein the constant $k_c$ is determined by imposing that the light emitted by said liquid crystal screen at a given level of grey remains constant as the effective adjusting signal ($P_{E,i+1}$) of the rear-lighting lamp and the contrast control signal ($C_{E,i+1}$) change, thereby recovering the brightness lost when reducing the power of said rear-lighting lamp.

8. Apparatus for improving the visual perception of an image displayed on a liquid crystal screen, comprising:

circuit means (17) for generating an effective adjusting signal ($P_{E,i+1}$) of a rear-lighting lamp depending on the value of a target power value ($P_T$) of said rear-lighting lamp;

said circuit means (17) for generating an effective image contrast control signal ($C_{E,i+1}$) depending on said effective adjusting signal ($P_{E,i+1}$) of the rear-lighting lamp, so as to increase, respectively decrease, the contrast of the image displayed on said screen as said effective adjusting signal ($P_{E,i+1}$) of the rear-lighting lamp decreases, respectively increases;

wherein said apparatus further comprises:

calculation means (5, 7, 9, 11) for calculating the average of the mean luminances ($y_i$) of a predetermined plurality of previous image frames;

calculation means (4, 13, 15) for calculating the distance ($d_i$) between the mean luminance ($y_i$) of a current image frame (H) and said average of the mean luminance ($S_i/2^N$) of said predetermined plurality of previous image frames; and circuit means (17) for calculating said target power value ($P_T$) of said rear-lighting lamp as a function of said average mean luminances ($S_i/2^N$) of said predetermined plurality of previous image frames if said distance ($d_i$) is less or equal to a threshold value ($t_L$) otherwise for calculating said target power value ($P_T$) of said rear-lighting lamp as a function of the mean luminance ($y_i$) of said current image frame (H) and for initializing the mean luminance of said predetermined plurality of previous image frames to the mean luminance ($y_i$) of the current image frame (H).

9. Apparatus according to claim 8, wherein said calculation means (4, 5, 7, 9, 11, 13, 15) and said circuit means (17) are implemented in a dedicated microprocessor of said apparatus.

10. Liquid crystal panel and/or screen comprising an apparatus according to one of claim 8 or 9.

* * * * *